US012022931B2

(12) United States Patent
Jourdain et al.

(10) Patent No.: US 12,022,931 B2
(45) Date of Patent: Jul. 2, 2024

(54) MECHANISM FOR A CONTAINER FOR APPLYING A COSMETIC PRODUCT AND CONTAINER COMPRISING SUCH A MECHANISM

(71) Applicant: ALBEA SERVICES, Gennevilliers (FR)

(72) Inventors: Marc Jourdain, Gennevilliers (FR); Mark Edmondson, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 29 days.

(21) Appl. No.: 17/234,759

(22) Filed: Apr. 19, 2021

(65) Prior Publication Data

US 2021/0321746 A1 Oct. 21, 2021

(30) Foreign Application Priority Data

Apr. 17, 2020 (FR) ..... 2003876

(51) Int. Cl.
*A45D 40/06* (2006.01)
*A45D 40/20* (2006.01)

(52) U.S. Cl.
CPC ..... *A45D 40/06* (2013.01); *A45D 40/065* (2013.01); *A45D 2040/208* (2013.01)

(58) Field of Classification Search
CPC ..... A45D 40/06; A45D 40/065; A45D 40/04; A45D 2040/208
See application file for complete search history.

(56) References Cited

U.S. PATENT DOCUMENTS

| | | | | |
|---|---|---|---|---|
| 5,000,356 | A | 3/1991 | Johnson et al. | |
| 6,139,208 | A | 10/2000 | Monin-Bareil | |
| 6,817,799 | B1 | 11/2004 | Petit | |
| 11,064,787 | B2 * | 7/2021 | Liu | A45D 40/06 |
| 11,129,463 | B2 * | 9/2021 | Dinata | A45D 40/06 |
| 11,246,394 | B2 * | 2/2022 | Liu | A45D 40/06 |
| 11,297,924 | B2 * | 4/2022 | Maurin | A45D 40/06 |
| 2021/0068517 | A1 * | 3/2021 | Trochel | A45D 40/06 |

FOREIGN PATENT DOCUMENTS

| | | |
|---|---|---|
| TW | M590900 | 2/2020 |
| WO | WO2008/031766 | 3/2008 |
| WO | WO2020/193497 | 10/2020 |

* cited by examiner

*Primary Examiner* — Jennifer C Chiang
(74) *Attorney, Agent, or Firm* — Kilpatrick Townsend & Stockton LLP

(57) ABSTRACT

A mechanism for a container for applying a cosmetic product is designed to cause the cosmetic product to exit by at least one rotational movement. The mechanism includes at least one plastic sheath and one plastic casing external to the sheath, the plastic material of the sheath and the plastic material of the casing are selected from polypropylene and/or polyethylene terephthalate.

10 Claims, 6 Drawing Sheets

[Fig.1]
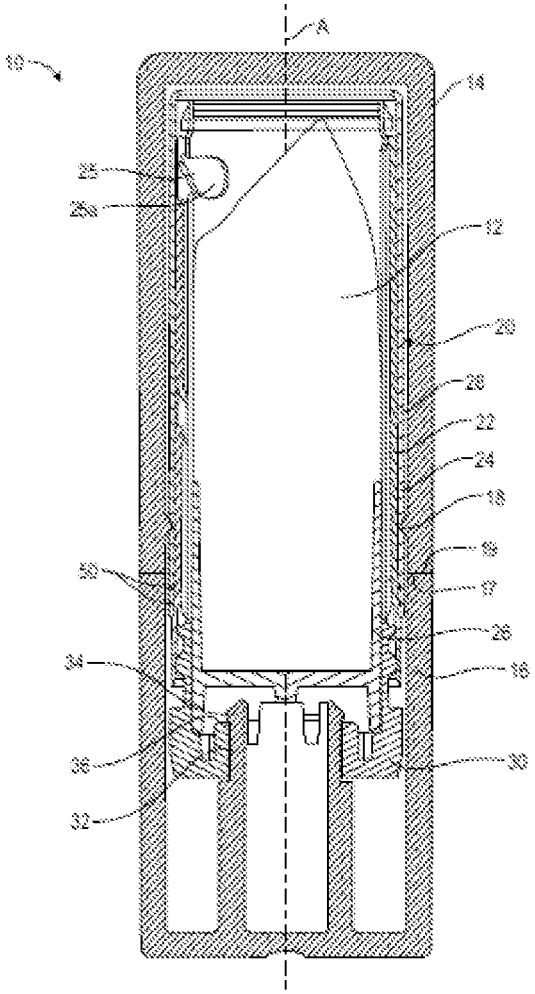

[Fig.2]
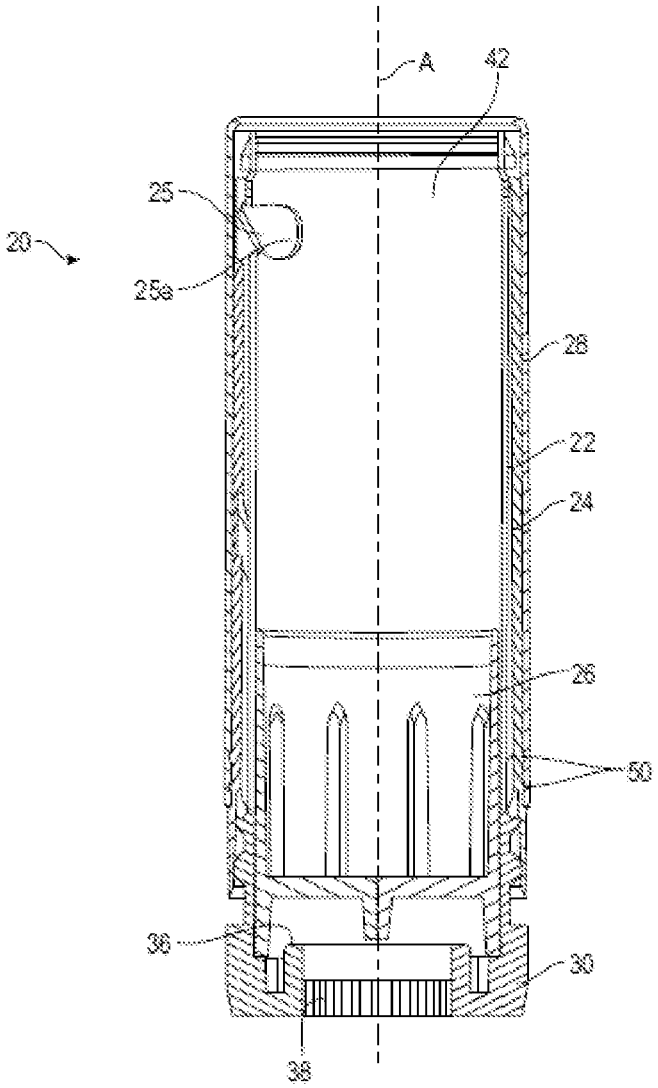

[Fig.3]
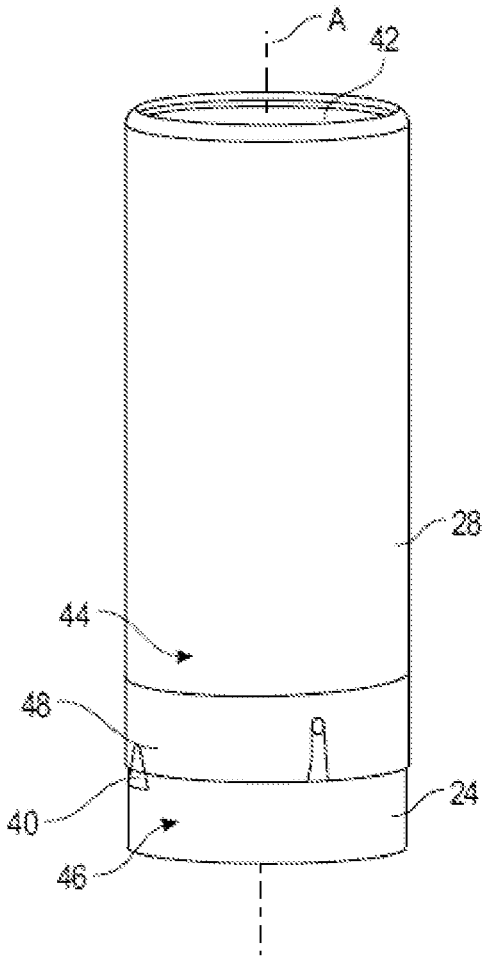

[Fig.4]
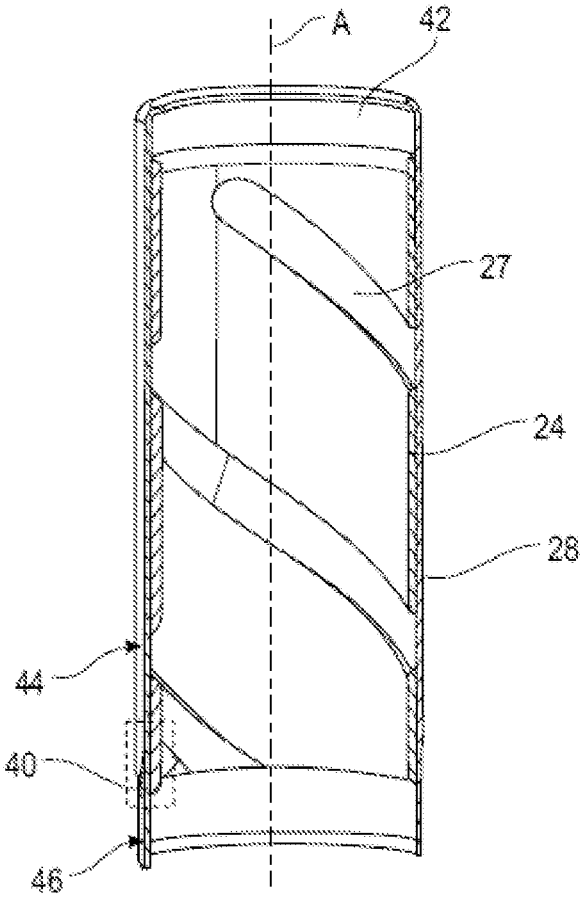

[Fig.5]
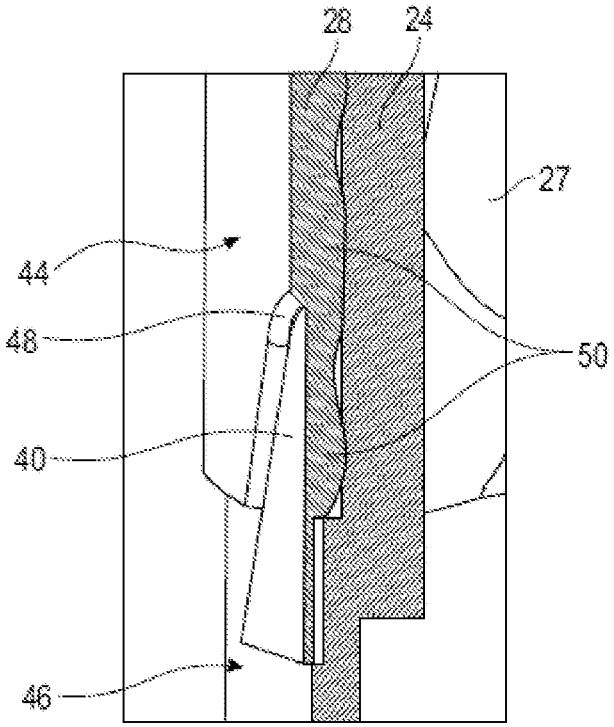

[Fig.6]
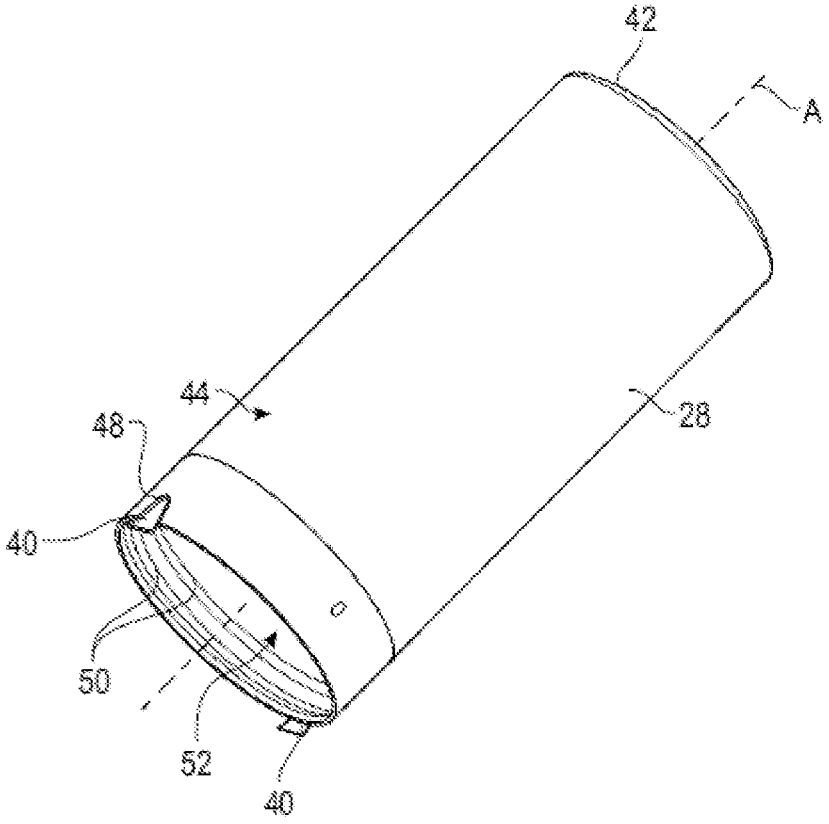

MECHANISM FOR A CONTAINER FOR APPLYING A COSMETIC PRODUCT AND CONTAINER COMPRISING SUCH A MECHANISM

CROSS REFERENCE TO RELATED APPLICATIONS

This application claims priority under 35 U.S.C. § 119(a) to French patent application number 2003876, filed on Apr. 17, 2020, the entire teachings of which are incorporated herein by reference.

BACKGROUND OF THE INVENTION

Field of the Invention

The invention concerns a mechanism for a container for applying a cosmetic product, in particular a stick of lipstick, and a container comprising such a mechanism

Description of the Related Art

Conventionally, containers for applying a cosmetic product, in particular a stick of lipstick, comprise a mechanism for moving the cosmetic product between a retracted position and an application position in which the cosmetic product can be applied by rubbing.

The actuation of the mechanism is generally controlled manually by applying a rotational movement to the base of the container, which rotational movement is transmitted to the mechanism to cause the axial movement of a cup comprising the cosmetic product.

This type of mechanism generally comprises at least one casing, also known as a sleeve, fitted over a sheath which participates in the movement of the cosmetic product. The casing is an aesthetically visible piece, as it extends outside the base of the container inside which the rest of the mechanism is housed.

Classically, the casing and the sheath are made as two separate pieces for which the material can be freely chosen. In such a design, the two pieces must be integrally bonded to each other.

Typically a metallic material, such as anodised aluminium, is chosen for the casing and a plastic material is chosen for the sheath of the mechanism.

The metallic material of the casing allows it to be mounted on the sheath by crimping, punching or gluing, which are techniques that have the advantage of ensuring both an axial and a rotational connection between the casing and the sheath.

On the other hand, the presence of two different materials, metal and plastic, presents disadvantages, particularly during recycling when the two pieces must be separated.

BRIEF SUMMARY OF THE INVENTION

The invention relates to a mechanism for a container for applying a cosmetic product, the mechanism being designed to cause the cosmetic product to exit by at least one rotational movement, the mechanism comprising at least:

- a sheath comprising internally at least one helical groove;
- a guide rotatably mounted in the sheath;
- a cup carrying the cosmetic product, the cup being mounted in the guide;
- an outer casing surrounding the sheath;

- the sheath and the casing being made of a plastic material selected from polypropylene and/or polyethylene terephthalate.

The plastic pieces can be easily obtained by injection moulding and result in a lightweight mechanism.

In addition, the plastic materials can be dyed, thus ensuring aesthetic quality.

Furthermore, the use of plastic materials, in particular similar plastic materials for the entire mechanism, facilitates recycling. In particular, polypropylene and polyethylene terephthalate are two plastics materials with a well-known recycling cycle.

According to various embodiments of the invention, which may be taken together or separately:

- the guide is surrounded by the sheath,
- the rotation of the guide in relation to the sheath causes an axial movement of the cup,
- the cup is made of a plastic material selected from polypropylene and/or polyethylene terephthalate,
- the guide is made of a plastic material selected from polypropylene and/or polyethylene terephthalate,
- all the pieces of the mechanism are made of plastic material selected from polypropylene and/or polyethylene terephthalate,
- the casing is held on the sheath by means of at least one thickened portion of material located between the sheath and the casing so that the sheath and the casing are secured at least in translation,
- the thickened portion of material also allows the sheath and the casing to be secured in rotation,
- the at least one thickened portion of material ensures a force fitting of the casing around the sheath,
- the at least one thickened portion of material is located on an inner surface of the casing,
- the at least one thickened portion of material is located on an outer surface of the sheath,
- the mechanism includes a plurality of thickened portions of material distributed over the inner surface of the casing,
- the mechanism includes a plurality of thickened portions of material distributed over the outer surface of the sheath,
- the at least one thickened portion of material is a material bead arranged around the periphery of the inner surface of the casing,
- the at least one thickened portion of material is a material bead arranged around the periphery of the outer surface of the sheath,
- the at least one thickened portion of material is two material beads arranged around the periphery of the inner surface of the casing,
- the at least one thickened portion of material is arranged on a lower portion of the casing and/or the sheath opposite an upper portion including an opening through which the cosmetic product can exit,
- the casing and the sheath are interfused in at least one point, referred to as the assembly point, so as to be secured in rotation and in translation,
- the casing has an outer surface on which the at least one assembly point is visible,
- the mechanism includes a plurality of assembly points,
- the plurality of assembly points is distributed around the periphery of the casing,
- the plurality of assembly points is evenly distributed around the periphery of the casing,
- the plurality of assembly points is distributed over the entire height of the casing, the plurality of assembly points is evenly distributed over the entire height of the casing, the at least one assembly point is a pattern, such as a logo, a letter, a text, etc.

The invention also relates to a container for applying a cosmetic product including a cover, an actuating base which includes a mechanism as described below, the actuating base allowing entry and/or exit of the cosmetic product.

Advantageously, the cover is made of a plastic material selected from polypropylene and/or polyethylene terephthalate and/or the base is made of a plastic material selected from polypropylene and/or polyethylene terephthalate.

Advantageously, a mechanism including an assembly point as described below is obtained by a method for obtaining same including a step in which the at least one assembly point is obtained by welding.

Advantageously, the welding is obtained by thermal punching.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 is an axial cross-sectional view showing a container after mounting a mechanism according to the invention on an actuating base of the container;

FIG. 2 is an axial cross-sectional view showing the mechanism of FIG. 1;

FIG. 3 is a perspective view of a set of a sheath and a casing including the mechanism of FIG. 2;

FIG. 4 is an axial cross-sectional view of the set of FIG. 3;

FIG. 5 is a magnified view of FIG. 4;

FIG. 6 is a perspective view of the casing of the set of FIG. 2.

DETAILED DESCRIPTION OF THE INVENTION

By convention, the "axial" direction corresponds to that of the main extension of the container, illustrated by the axis A in the figures, and the "radial" direction is orthogonal to the axial direction.

In the following detailed description of the figures, the terms "upper" and "lower" or "top" and "bottom" will be used without limitation in reference to the axial direction.

Similarly, the terms "outside, outer or external" and "inside, inner or internal" are used in reference to the radial direction, an external element being radially further from the axis A than an inner element.

In the following description, elements with identical structure or similar functions will be referred to by the same references.

An example of an embodiment of a container 10, also called a case, of a cosmetic product 10 is shown in FIG. 1.

In the example of embodiment, the cosmetic product is a stick 12 of cosmetic product and more particularly, the stick 12 of cosmetic product is a lipstick stick intended to be applied by rubbing, alternatively a lip care balm.

The container 10 includes at least one cover 14 which is associated with an actuating base 16 having a complementary shape, the base 16 and the cover 14 together defining an outer contour of the container 10.

The container 10 further includes a mechanism 20 for dispensing the stick 12 of cosmetic product.

In a non-limiting way, the cover 14, the base 16 of the container 10 and the mechanism 20 have a cylindrical shape of circular cross-section.

Preferably, the cover 14 is removable. The cover 14 is capable of occupying at least one opening position in which the cover 14 is separated from the base 16 with a view, in particular, to allowing the application of the cosmetic product and a closed position in which the cover 14 is secured with the base 16 (FIG. 1).

The lower part of the cover 14 includes on the inside at least one annular bead 18 which is intended to cooperate with an external cylindrical surface of the mechanism 20.

Advantageously, the annular bead 18 ensures that the cover 14 is held in the closed position and participates in obtaining an airtight closure in order to guarantee good conservation of the stick 12 of cosmetic product, during use of the mechanism 20.

The cover 14 includes a lower edge 19 which is capable of abutting against an upper edge 17 of the actuating base 16 in the closed position.

In one embodiment, not shown, the base 16 may include a shoulder which extends radially at the connection of the upper part of the base 16 with a lower part of larger diameter. The lower edge of the cover 14 is then likely to abut the shoulder in the closed position.

An example of an embodiment of the mechanism 20 is illustrated in FIG. 2.

The mechanism 20 has a main axis which extends in the axial direction, coincident with the main axis A of the container 10.

The mechanism 20 is intended to be removably or non-removably mounted on an actuating base 16, for example the actuating base 16 of the cosmetic product container 10 described above.

In the case of a removable mechanism 20, the latter is intended to be changeable, in particular but not exclusively after the cosmetic product 12 has been fully used.

The mechanism 20 and its mechanism for entry and/or exit of the cosmetic product 12 described below are only given as a non-limiting example.

In the example embodiment, the mechanism 20 includes an inner guide 22 whose rotation relative to an external sheath 24 causes an axial movement of a cup 26 carrying the stick 12 of cosmetic product allowing an entry and/or exit of the stick 12 of cosmetic product. In other words, the guide 22 is rotatably mounted in the sheath 24. The cup 26 is mounted in the guide 22.

The cup 26 includes at least one lug (not visible), preferably two diametrically opposed lugs.

The lugs cooperate respectively with slides 25 of the guide 22, the slides 25 extending axially in a straight line. Each slide 25 advantageously includes, at each of its upper and lower ends, an angular indentation 25*a* forming an abutment for the lugs of the cup 26.

The sheath 24 surrounds the guide 22. The sheath 24 internally includes two helical grooves 27 with which the free end of the lugs respectively co-operate, each lug passing radially through the associated slide 25 of the guide 22 to engage a groove 27.

The mechanism 20 also includes a casing 28, also called a sleeve or liner. The casing 28 surrounds the sheath 24.

According to the invention, the casing 28 and the sheath 24 are made of plastic material.

The plastic material of the casing 28 and the plastic material of the sheath 24 may be selected from polypropylene and/or polyethylene terephthalate.

The casing 28 and the sheath 24 may be made of the same plastic material or of two different plastic materials. Preferably, the casing 28 and the sheath 24 are made of the same plastic material.

Advantageously, the cup 26 and/or the guide 22 are also provided in plastic material selected from polypropylene and/or polyethylene terephthalate.

Thus, advantageously, all the pieces of the mechanism 20 are made of plastic material selected from polypropylene and/or polyethylene terephthalate.

The plastic pieces can be easily obtained by injection moulding and lead to a lightweight mechanism 20.

In addition, the plastic materials can be dyed, thus ensuring aesthetic quality.

Furthermore, the use of plastic materials, in particular similar plastics materials for the entire mechanism 20 facilitates recycling. In particular, polypropylene and polyethylene terephthalate are two plastic materials whose recycling cycle is well known.

Advantageously, the cover 14 and/or the base 16 are also made of a plastic material selected from polypropylene and/or polyethylene terephthalate.

The cover 14 and the base 16 may be made of the same plastic material or of two different plastic materials. Preferably, the cover 14 and the base 16 are made of the same plastic material.

Advantageously, the entire container 10 i.e. the whole mechanism 20, as well as the cover 14 and the base 16 are made of a plastic material selected from polypropylene and/or polyethylene terephthalate, in particular of the same plastic material.

Again, the use of plastics materials, in particular similar plastic materials for the entire container 10 facilitates the obtaining of the pieces which can be easily obtained by injection moulding and lead to a lightweight container 10.

In addition, the plastic materials can be coloured and thus guarantee an aesthetic quality.

Furthermore, the use of plastics materials, in particular similar plastics materials for the entire mechanism 20 facilitates recycling. In particular, polypropylene and polyethylene terephthalate are two plastic materials, the recycling cycle of which is well known.

The guide 22 includes a knob 30. The knob 30 is located axially at the lower end of the guide 22.

The knob 30 is intended to allow the guide 22 to rotate, causing, according to the direction of rotation, an axial movement of the cup 26 up or down and thus of the stick 12 of cosmetic product.

In this embodiment, the knob 30 is a separate piece that is attached to the guide 22. Alternatively, the knob 30 is made in one piece with the guide 22 of the mechanism 20.

In such a container 10, the knob 30 of the mechanism 20 is actuated, after having previously removed the cover 14, by means of the base 16.

In an alternative embodiment, the casing 28 and/or the sheath 24 are extended axially beyond the knob, in order to prevent or at least make the access to the knob 30 difficult. Such a configuration enables to limit the actuation of the mechanism 20 by a user even before the mechanism 20 has been associated with the corresponding base 16.

Consequently, the knob 30 and the base 16 must on the one hand be connected axially together and, on the other hand, be linked in rotation to ensure the transmission to the knob 30 of the mechanism 20 of any rotational movement applied to the base 16.

To this end, the actuating base 16 includes fixing means for axially linking the actuating base 16 with the knob 30 of the mechanism 20.

The fixing means includes four tabs 32 which extend axially upwardly from a low part of the actuating base 16.

The four tabs 32 of the actuating base 16 are evenly angularly distributed at 90°. The tabs 32 are inserted into a complementary hole which is centrally provided in the knob 30 of the mechanism 20. Advantageously, the tabs 32 are flexible.

The free end of each tab 32 is configured to form a hook 34 which engages an upper edge 36 of the hole in the knob 30 to axially lock the actuating base 16.

The fixing tabs 32 allow the actuating base 16 to be axially linked to the knob 30 of the mechanism 20.

The rotational locking of the knob 30 and the base is achieved by a complementary notching of the knob 30 and the tabs 32, i.e., a set of ridges 38 which extend axially, parallel to each other on an inner surface of the knob 30 and on the outer surface of the tabs 32 of the base 16.

In such a mechanism 20, the casing 28 and the sheath 24 are secured in rotation and translation.

For this purpose, the casing 28 is further held on the sheath 24 by means of at least one thickened portion 50 of material located between the sheath 24 and the casing 28 so that the sheath 24 and the casing 28 are secured at least in translation.

In other words, the thickened portion 50 of material ensures a force fitting of the casing 28 around the sheath 24, thereby improving their retention, in particular with regard to tearing and rotation in relation to each other. Furthermore, the use of a thickened portion 50 of material between the casing 28 and the sheath 24, in other words in an internal zone of the mechanism 20, enables to maintain a good visual appearance of the mechanism 20.

Thus, the thickened portion 50 of material may be located on an inner surface 52 of the casing 28 (embodiment shown here) or on the outer surface 46 of the sheath 24 (not shown) or on the inner surface 52 of the casing 28 and on the outer surface 46 of the sheath 24 (not shown).

This may be, for example, a single thickened portion 50. Advantageously, this may be, for example, a thickened portion 50 which extends around the entire periphery of the inner surface 52 of the casing 28 and/or the outer surface 46 of the sheath 24, such as a bead.

The mechanism 20 may also include a plurality of thickened portions 50 of material distributed over the inner surface 52 of the casing 28 and/or the outer surface 46 of the sheath 24.

The thickened portions 50 of material may be discrete points distributed throughout the inner surface 52 of the casing 28 and/or the outer surface 46 of the sheath 24.

The thickened portions 50 of material may also be discrete points distributed around the entire periphery of the inner surface 52 of the casing 28 and/or the outer surface 46 of the sheath 24, so as to form a discontinuous bead, for example.

Alternatively, there may be thickened portions 50 extending around the entire periphery of the inner surface 52 of the casing 28 and/or the outer surface 46 of the sheath 24, such as beads.

In the embodiment shown here, the at least one thickened portion 50 of material is two material beads 50 arranged around the periphery of the inner surface 52 of the casing 28 at the lower portion of the casing 28 and the sheath 24 where there are two assembly points 40 mentioned below.

In the embodiment shown here, the casing 28 and the sheath 24 being both made of plastic material, they are furthermore interfused in at least one point, the so-called assembly point 40, so as to be secured in rotation and translation.

The casing and the sheath, which had previously been two separate pieces, now form a single piece and are permanently joined together at the at least one assembly point. This is made possible in particular by mixing the plastic materials of the casing and the sheath at the assembly point.

Advantageously, in the embodiment shown here, the mechanism 20 includes two diametrically opposed assembly points 40.

The two assembly points 40 are arranged on a lower portion of the casing 28 and the sheath 24 opposite an upper portion including an opening 42 through which the cosmetic product can exit.

Thus, the two assembly points 40 are visible on an outer surface 44 of the casing 28.

In particular, in the embodiment shown here, each of the assembly points 40 is disposed on both the outer surface 44 of the casing 28 and an outer surface 46 of the sheath 24.

The assembly point 40 is in the form of a recessed triangle having an upper apex 48 (i.e., an apex directed towards the upper portion including the opening) rounded.

Advantageously, the at least one assembly point 40 is obtained by a method for obtaining the same including a step in which the at least one assembly point 40 is obtained by welding, such as for example thermal punching.

The thermal punching may be obtained by applying, striking at least one thermally controlled punch to the outer and/or inner surfaces of the casing 28 and/or the sheath 24. The application time of the punch(s) is defined according to the size of the mechanism 20, the type of plastic material, the thickness of the casing 28 and/or the sheath 24, the desired final level of fusion between the casing 28 and the sheath 24.

To achieve the illustrated embodiment, two diametrically opposed punches in the shape of a triangle were struck on the outer surfaces 44, 46 of the casing 28 and the sheath 24.

In this way, the casing 28 and the sheath 24 are interfused together by heating and pressing an area forming the assembly point 40. In other words, in this area, the plastic materials of the casing 28 and the sheath 24 melt under heat and mix to form the assembly point 40, in particular after the area has cooled down. The pressure exerted during punching creates a mark forming the assembly point 40.

The melting of the casing 28 and the sheath 24 can be detected by a mixing of the materials of the sheath 24 and the casing 28.

In the case of a different coloured casing 28 and a sheath 24, the assembly point 40 may show a difference in colour from the rest of the casing 28 and sheath 24 due to the mixing of the two plastic materials. The assembly point 40 is thus visible. This change in colour is particularly noticeable when the assembly point 40 is located on the outer surfaces 44, 46 of the casing 28 and the sheath 24. This difference in colour is particularly visible in the area of the casing 28 adjacent to the sheath 24 and in the area of the sheath 24 adjacent to the casing 28.

The assembly point 40 is also visible by a recessed mark left by the punching on the outer surface 44 of the casing 28 and/or on the outer surface 46 of the sheath 24.

Advantageously, the at least one assembly point 40 may represent a pattern, such as a logo, letter, text, or any other suitable pattern.

In the case of a plurality of assembly points 40, these may be distributed around the periphery of the casing 28, as shown here with two assembly points 40.

The assembly points 40 may also be distributed over the entire height of the casing 28 (not shown).

The distribution may be regular or random.

In another embodiment not shown, the mechanism 20 may also include a single assembly point 40.

In contrast to known techniques, such as clamping or gluing, the presence of a thickened portion between the casing and the sheath and/or the fusion between these two pieces allows a connection between the casing and the sheath which is advantageously simple, reliable and economical.

In fact, the two pieces can be assembled by clamping, but very often this is not sufficient, especially at the level of the axial connection.

Another solution for assembling the two pieces is the technique of gluing. However, the use of glue when the two pieces are assembled by gluing leads to risks of pollution of the cosmetic product by the glue, the quantity and distribution of which is difficult to control with great precision during assembly Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are pos-sible without departing from the scope of the invention defined in the appended claims as follows:

What is claimed is:

1. A mechanism for a container for applying a cosmetic product, the mechanism being designed to cause the cosmetic product to exit by at least one rotational movement, said mechanism comprising at least:

a sheath comprising internally at least one helical groove;

a guide rotatably mounted in the sheath;

a cup carrying the cosmetic product, said cup being mounted in the guide;

an outer casing surrounding the sheath, the casing and the sheath being secured in rotation;

the sheath and the casing being made of a plastic material selected from polypropylene and/or polyethylene terephthalate, wherein the mechanism comprises a plurality of thickened portions of material distributed over the inner surface of the casing and/or the outer surface of the sheath.

2. The mechanism according to claim 1, wherein said plurality of thickened portion of material ensures a force fitting of the casing around the sheath.

3. The mechanism according to claim 1, wherein said plurality of thickened portion of material is located on an inner surface of the casing and/or on an outer surface of the sheath.

4. The mechanism according to claim 3, wherein said plurality of thickened portion of material is a material bead arranged around the periphery of the inner surface of the casing and/or of the outer surface of the sheath.

5. The mechanism according to claim 4, wherein said plurality of thickened portion of material is two material beads arranged around the periphery of the inner surface of the casing.

6. The mechanism according to claim 1, wherein said plurality of thickened portion of material is arranged on a lower portion of the casing and/or of the sheath opposite an upper portion comprising an opening through which the cosmetic product can exit.

7. The mechanism according to claim 1, wherein the cup is made of a plastic material selected from polypropylene and/or polyethylene terephthalate.

8. The mechanism according to claim 1, wherein the casing and the sheath are interfused in at least one point, referred to as the assembly point, so as to be secured in rotation and in translation.

9. A container for applying a cosmetic product comprising:

a cover;

an actuating base which comprises a mechanism, the mechanism comprising a sheath comprising internally at least one helical groove;

a guide rotatably mounted in the sheath;

a cup carrying the cosmetic product, said cup being mounted in the guide;

an outer casing surrounding the sheath, the casing and the sheath being secured in rotation;

wherein the mechanism comprises a plurality of thickened portions of material distributed over the inner surface of the casing and/or the outer surface of the sheath, the sheath and the casing being made of a plastic material selected from polypropylene and/or polyethylene terephthalate;

the actuating base allowing entry and/or exit of the cosmetic product.

10. The container according to claim 9, wherein the cover is made of plastic material selected from polypropylene and/or polyethylene terephthalate and/or the base is made of plastic material selected from polypropylene and/or polyethylene terephthalate.

* * * * *